US009068330B2

(12) United States Patent
Schultz

(10) Patent No.: US 9,068,330 B2
(45) Date of Patent: Jun. 30, 2015

(54) DISSOLVABLE BATHROOM DEVICE

(76) Inventor: Larry D. Schultz, Odenton, MD (US)

( * ) Notice: Subject to any disclaimer, the term of this patent is extended or adjusted under 35 U.S.C. 154(b) by 285 days.

(21) Appl. No.: 12/986,748

(22) Filed: Jan. 7, 2011

(65) Prior Publication Data

US 2012/0011643 A1 Jan. 19, 2012

Related U.S. Application Data

(60) Provisional application No. 61/338,552, filed on Feb. 22, 2010.

(51) Int. Cl.

| | |
|---|---|
| ***E03D 11/00*** | (2006.01) |
| ***E03D 9/00*** | (2006.01) |
| ***A47K 11/10*** | (2006.01) |
| ***E03C 1/308*** | (2006.01) |

(52) U.S. Cl.

CPC . *E03D 9/00* (2013.01); *A47K 11/10* (2013.01); *E03C 1/308* (2013.01)

(58) Field of Classification Search

CPC ..... A46B 5/0095; A46B 7/04; A46B 7/042
USPC ..... 4/255.01, 255.11, 231, 222; 15/104.94
See application file for complete search history.

(56) References Cited

U.S. PATENT DOCUMENTS

| | | | | |
|---|---|---|---|---|
| 4,137,577 | A * | 2/1979 | Maxfield | 4/231 |
| 4,457,038 | A | 7/1984 | Hammond | |
| 5,471,697 | A | 12/1995 | Daconta | |
| 5,551,115 | A * | 9/1996 | Newville | 15/172 |
| 5,985,443 | A | 11/1999 | Honeycutt et al. | |
| 6,192,525 | B1 * | 2/2001 | Tash | 4/255.11 |
| 6,374,427 | B1 | 4/2002 | Tash | |
| 7,065,825 | B2 | 6/2006 | Minkler et al. | |
| 7,124,450 | B2 | 10/2006 | Davidson | |
| 7,159,265 | B2 | 1/2007 | Soller et al. | |
| 7,287,295 | B2 | 10/2007 | Treacy et al. | |
| 7,316,046 | B2 | 1/2008 | Michaels et al. | |
| 7,386,910 | B2 | 6/2008 | Minkler et al. | |
| 7,386,913 | B2 | 6/2008 | Jackson | |
| 7,530,138 | B1 | 5/2009 | Platt | |
| 7,650,663 | B2 | 1/2010 | Michaels et al. | |

(Continued)

FOREIGN PATENT DOCUMENTS

| | | |
|---|---|---|
| WO | 01-43618 | 6/2001 |

OTHER PUBLICATIONS

International Search Report received Sep. 6, 2012 in corresponding International Application No. PCT/US2012/020311 dated Aug. 29, 2012.

(Continued)

*Primary Examiner* — Janie Christiansen
(74) *Attorney, Agent, or Firm* — Banner & Witcoff, Ltd.

(57) ABSTRACT

A bathroom device with a single use dissolvable functional head with a plunger head or a cleaning head is described. The bathroom device may include an elongated handle coupled at a first end to the to the single use dissolvable functional head. The device may also include a single use dissolvable sleeve covering a portion of the elongated handle and a release mechanism for releasing the single use dissolvable functional head from the first end of the elongated handle. The single use dissolvable sleeve may be configured to slide off the elongated handle when the single use dissolvable functional head has been released. A method of using the bathroom device is also described.

26 Claims, 12 Drawing Sheets

(56) References Cited

U.S. PATENT DOCUMENTS

| | | | | |
|---|---|---|---|---|
| 7,743,451 | B2 | 6/2010 | Kim | |
| 2005/0125922 | A1 | 6/2005 | Szarawarski | |
| 2005/0246848 | A1 | 11/2005 | Morgan et al. | |
| 2007/0079460 | A1 | 4/2007 | Tapp et al. | |
| 2007/0089224 | A1 * | 4/2007 | Wildauer et al. | 4/255.11 |
| 2008/0115302 | A1 | 5/2008 | Kilkenny et al. | |
| 2008/0263797 | A1 | 10/2008 | Berger et al. | |

OTHER PUBLICATIONS

"Air Power Drain Cleaner Deluxe," http://www.cheaponsale.com/buy-toilet_plunger_air/. Viewed on Dec. 27, 2010.

"Biodegradable Foam Plastic Substitute Made from Milk Protein and Clay," www.sciencedaily.com/releases/2010/10/101020121218.htm; ScienceDaily, Oct. 20, 2010.

* cited by examiner

DISSOLVABLE BATHROOM DEVICE

This application claims priority to U.S. Provisional Patent Application Ser. No. 61/338,552, filed Feb. 22, 2010, herein incorporated by reference in its entirety.

FIELD OF THE INVENTION

The present invention is generally directed to home products. More particularly, aspects of the invention pertain to bathroom products including plungers.

BACKGROUND

Most people find toilets to be unsanitary and unpleasant to handle. Toilets are typically one of the regions of the home people least like to clean or service because of the nature of their use for human excrement including feces and urine. Further, cleaning or servicing tools used on toilet bowls spread dirt, contaminants, and other unsanitary material throughout the room containing the toilet and the remainder of the home or commercial space depending on where these tools are stored. In some instances a toilet brush may be housed in the bathroom, often next to the toilet or in a cabinet. The toilet brush may be housed in a holding or disguising container. While perhaps an improved appearance over a toilet brush, the disguising container when in open sight, still is unsightly.

It may also be extremely difficult to not distribute contaminated water or fluids from the bowl after cleaning or otherwise servicing a toilet bowl as the servicing end of a toilet brush, plunger, or other device is placed in the interior of the toilet bowl. The interior is often filled with water and other liquids and may even be filled with excrement or other material in the instance of a clogged toilet. After use of the toilet servicing tool a user removes the servicing tool for storage. Inherently the tool will drip or otherwise disperse the contaminants from the interior of the toilet to the exterior of the toilet and the remainder of the bathroom, home, office, or building depending on where the toilet servicing tool might be stored. Also after using a toilet servicing device a user may attempt to rinse the brush in the toilet. While rinsing may remove some of the contaminates, cleaning chemicals or the like, some of these materials will remain on the servicing device after use and the servicing device can develop an unpleasant odor. It is also common for clogs, backups or obstructions to occur in the plumbing of various buildings including spaces like bathrooms, kitchens and other spaces in which plumbing is utilized. Plungers are known and are useful for removing clogs that occur in plumbing including the plumbing of toilets, sinks, tubs and showers. They are often kept in the corner of bathrooms, behind or adjacent to the toilet or under a sink or in a cabinet.

Various configurations of plungers are available, however, most have substantially similar features. Known plungers typically have a plunger head with a domed shape attached to an elongated stick or handle that a user is able to hold and use to manipulate the plunger. A user places the domed plunger head over plumbing in which there is a clog, backup or obstruction. The user pushes the plunger head downward to compress the plunger head and form a seal over a temporary seal on the plumbing. After compressing the plunger head and forming a temporary seal, a user pulls up on the plunger and, because of the force applied by a user on the handle, the space within the sealed plunger head expands creating a suction force which loosens a clog, backup, or obstruction to facilitate further passage of liquids and other materials through the plumbing. Once the plunger has been used it may be returned to the location it is stored. Because the clog likely caused a backup, the plunger especially the plunger head and the portions of the handle near where the handle is fixed to the plunger head may get wet and dirty.

Removal of the plunger from the location of the clog often creates unsanitary conditions in which dirt, contaminates, and other unsanitary material is spread or inadvertently dripped throughout bathrooms and other rooms in which the clog occurred. This phenomenon is especially true in bathrooms with toilets in which human excrement including urine and/or fecal matter may be in the water of the toilet bowl when the clog occurs. While disposable brush heads are known, these devices suffer drawbacks in that they become trash and/or they fall apart during the cleaning process as their designs disintegrate easily and they cannot withstand vigorous scrubbing or pressure application such as forces required in plunging a toilet. Also, while disposable brush heads may reduce the extent of contamination to some degree, they still provide contamination since the head is removed from the toilet. The remainder of the toilet servicing device including the elongated bar or handle to which the disposable brush is attached also will be contaminated in known toilet servicing devices, thereby limiting the effectiveness of the disposable brush head to improve sanitation. Further improving the sanitary conditions of bathrooms and limiting spread of contamination or odor is desirable.

SUMMARY

This summary is provided to introduce a selection of concepts in a simplified form that are further described below in the Detailed Description. The Summary is not intended to identify key features or essential features of the claimed subject matter, nor is it intended to be used to limit the scope of the claimed subject matter.

A first aspect of the invention provides for a bathroom apparatus with a single use dissolvable functional head. The functional head in varied configurations may be a plunger head, a cleaning head and/or other varied functional heads. The single use dissolvable functional head may be releasably coupled to an elongated handle at a first end. A release mechanism which may include a release activator and male and female components housed on the elongated handle and the functional head respectively or vice versa may take a variety of configurations. The bathroom apparatus may also include a single use dissolvable sleeve covering a portion of the elongated handle. The single use dissolvable sleeve may be configured to slide off the elongated handle when the single use dissolvable functional head is released, for example into a toilet bowl or other disposal location. The dissolvable functional head and/or dissolvable sleeve may be composed of a dissolvable material configured to provide desired functional attributes and also to dissolve in part of completely such as when placed in water of a toilet bowl or tub. As such, the functional head may be soluble in water or other substances and the dissolvable functional head and/or dissolvable sleeve may dissolve at varied rates as desired. As such, the material is strong enough to withstand hydraulic loads from plunging yet still be dissolvable in cold water typically found in toilets.

Another aspect of the invention provides for a plunger with a dissolvable plunger head, an elongated handle coupled at a first end to the dissolvable plunger head, and a release mechanism configured for releasing the dissolvable plunger head from the first end of the elongated handle. The release mechanism may have male and female components and a release activator of varied configurations. The plunger may be bellowed or have varied shapes to facilitate functionality or solubility. The plunger may also be pressurized or may include $CO_2$ or air canisters to facilitate plunging or drain cleaning.

A further aspect of the invention provides for a bathroom apparatus, dissolvable functional heads, and/or dissolvable sleeve configured as part of a kit. The kit may include one or more bathroom apparatus, one or more dissolvable functional heads and/or one or more dissolvable sleeves as well as other features and mechanisms as described herein.

In yet another aspect of the invention, a method of disposing of a functional head such as a plunger head in a toilet is provided. The method may include the steps of causing a release mechanism to release the plunger head coupled to an elongated handle and causing at least a portion of the plunger head to dissolve. The plunger head may dissolve at varied rates. In certain configurations, the rate may be determined by the material composition of the plunger head. The plunger head may be released as a result of activation of a user input such as an activator. The plunge head may be caused to dissolve completely in a fluid such as water in a toilet bowl or a tub and the toilet may be flushed to discard the plunger head.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
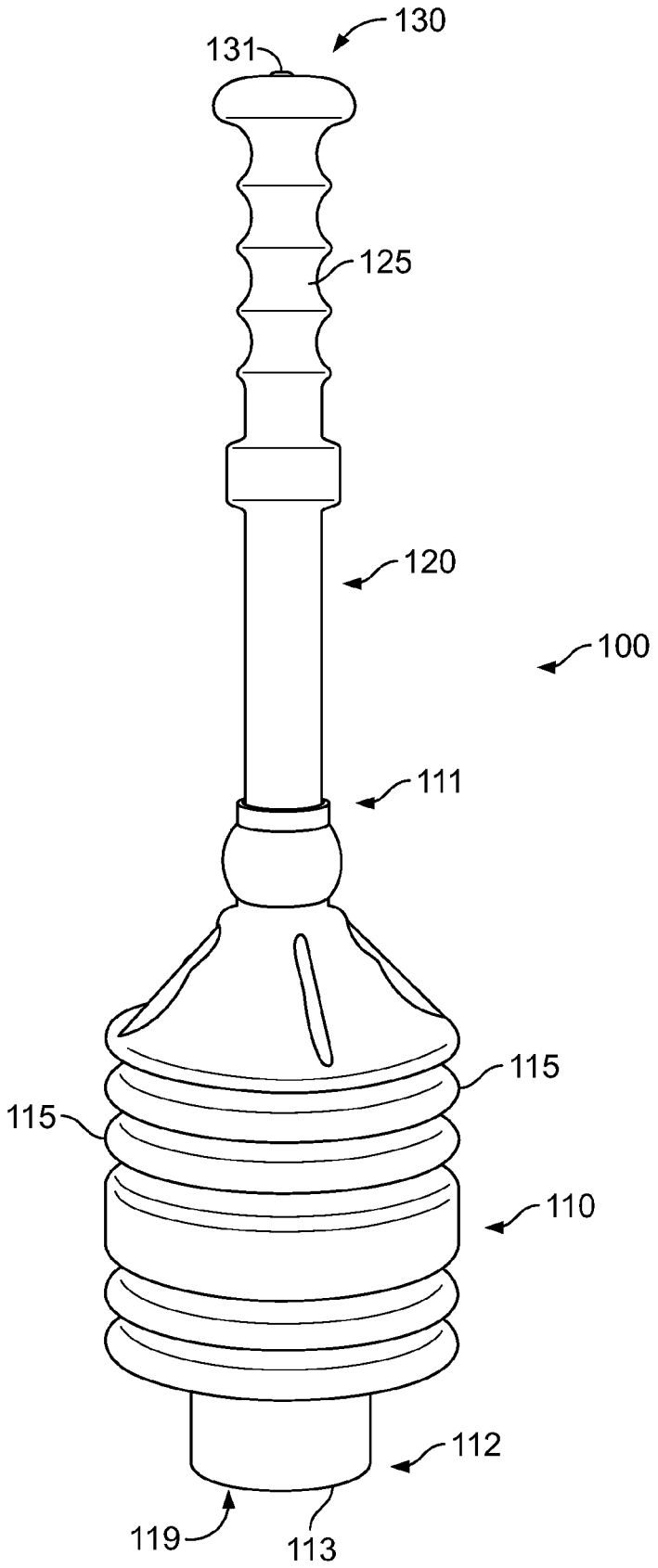
FIG. 1 is an illustrative perspective view of a first configuration of a bathroom apparatus.

FIG. 1 is an illustrative perspective view of a first configuration of a bathroom apparatus. The bathroom apparatus 100 may generally be described as having a functional head 110, an elongated handle 120, and a release mechanism 130. As is apparent from FIG. 1, the bathroom apparatus may in some instances have a generally linear alignment in which the functional head 110 is releasably coupled to a first end of the elongated handle 120 and a release activator 131 is coupled to a second end opposite from the functional head 110.

The elongated handle 120 may have a variety of particular configurations including varied cross-section, length, cross-sectional shape, and material to name just a few. Also, the elongated handle 120 may be formed as a single piece or a multiple piece member coupled together. The elongated handle 120 may be made of wood, plastics, metals, or a variety of other polymers or materials conventional used for toilet servicing devices. Depending on the particular configuration, the elongated handle 120 may be hollow and may contain components of the release mechanism 130 or other features. In some instances, more durable and/or more expensive materials may be used with the elongated handle 120 having an extended life especially since the functional head 110 may be replaceable thereby allowing the bathroom apparatus 100 to have an extended life compared to conventional toilet servicing apparatus. Varied cross-sectional shapes may be utilized including round, ovular, rectangular and triangular to name a few. Others may also be used. A particular cross-sectional shape may be utilized in some configurations to facilitate the releasable connection between the elongated handle 120 and the functional head 110. Likewise, particular cross-section shape of the elongated handle 120 may facilitate expulsion of a sleeve housed on and covering a portion of the elongated handle 120.

The elongated handle 120 may also include a grip 125. The grip 125 may be housed on an end opposing the functional head 110 to provide increased mechanical advantage and directional control abilities. Also, placement of the grip 125 at an increased distance from the functional head 110 further facilities prevention of the user's hands from being contaminated from use of the bathroom apparatus 100 when the bathroom apparatus is put into service in a toilet bowl 701 or other environments. As shown in FIG. 1, the grip 125 may be configured in complimentary shape to a human hand including cutouts for fingers to wrap around the grip 125. The grip 125 may be integrally formed with the elongated handle 120 or may be attached to the elongated handle 120 as a slide on, snap on, or pinch over component, or any other manner of fastening a grip onto a bar as is well known in the art. The grip 125 may be made of rubber, plastic, foam or a variety of other materials commonly known for grips. These materials may have enhanced cushion or grip capabilities and may even include grip enhancing features such as treads to facilitate the user's grip on the device.

Figure 2:
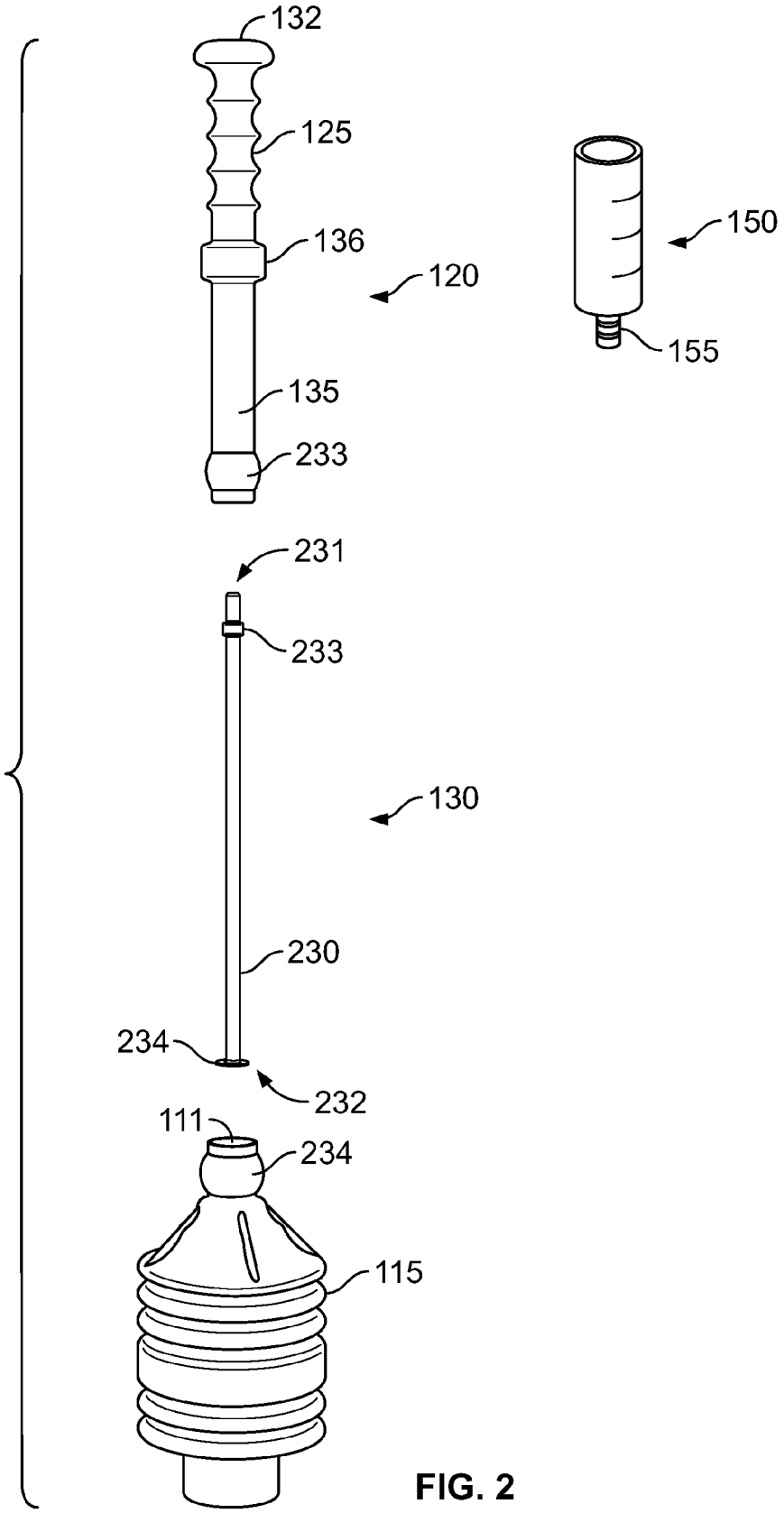
FIG. 2 is an illustrative exploded view of the bathroom apparatus of FIG. 1.

Here, the elongated handle 120 houses the release mechanism 130 for the bathroom apparatus as is illustratively shown in the exploded view in FIG. 2. While the term release mechanism is used throughout for ease of explanation and understanding, it should be understood that the release mechanism 130 may be the same mechanism used for attachment of the functional head 110 to the remainder of the bathroom apparatus as well as release from the elongated handle. For example, the release mechanism in FIGS. 1-9 facilitates attachment and removal of functional head 110. It should also be understood that a compressed air container may also be utilized as a release mechanism. In such an instance the compressed air is released and in escaping from its container forces the functional head 110 off of the elongated handle 120.

FIG. 2 is an exploded view of the bathroom apparatus of FIG. 1 and illustratively depicts the components of one configuration of the release mechanism 130. In this configuration, a push rod 230 is housed within the elongated handle 120 and extending the length of the elongated handle 120. Near the grip end or top 231 of the push rod 230 is housed the push rod shoulder 233. The push rod shoulder 233 may be formed to facilitate alignment of the push rod 230 within the elongated handle 120. For example, the push rod shoulder 233 may help secure the position and alignment of the push rod 230 within the internal cavity 139 of the elongated handle. On the opposing functional head end or bottom 232 of the push rod 230 is an ejector plate 234 for facilitating ejection or release of the functional head 110. The elongated handle 120 also includes a male ball socket connector 233 while the functional head 110 includes a complimentary shaped female connector 234 that acts as a sleeve with a complimentary squeeze fit over the male socket connector. The illustrative alignment of certain features of the release mechanism 130 may be further apparent in the illustrative cross section diagram of the bathroom apparatus of FIG. 1 shown in FIG. 3. The bathroom apparatus is shown in FIGS. 1 and 3 as being in an engaged, secured and/or non-released state in which the functional head 110 is coupled to the elongated handle 120 and the bathroom apparatus 100, here a plunger, may be used to service a toilet, drain or other plumbing.

Figure 3:
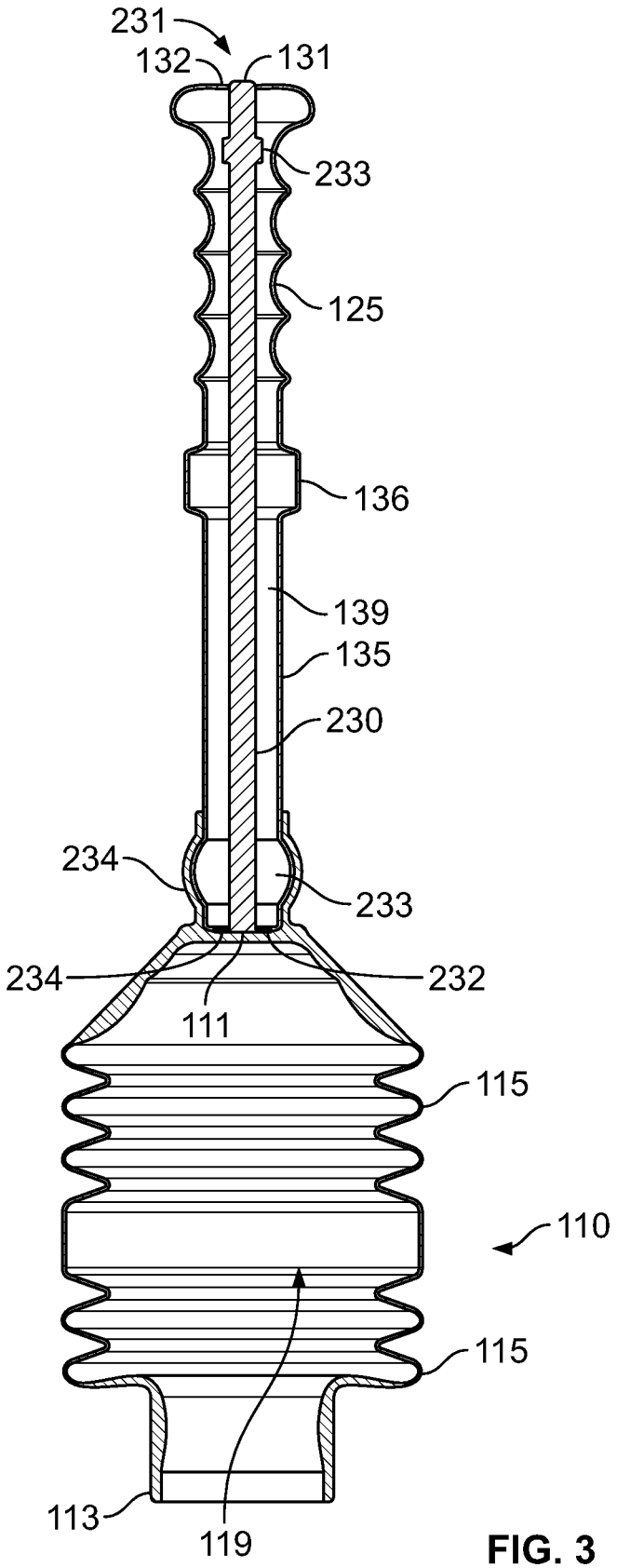
FIG. 3 is an illustrative cross section view of the bathroom apparatus of FIG. 1.

In the engaged state depicted in FIGS. 1 and 3, the release mechanism 130 is configured such that the top 231 of push rod 230 sits flush with top 231 of the elongated handle 120. The end of the push rod 230 is housed in orifice 132 and acts as a release activator 131. A user, when wishing to release the functional head 110 can push or press release activator 132. In doing so, the push rod 230 is moved downward within the elongated handle 120. With the push rod 230, ejector plate 234 in particular, abutted against a top surface 111 of the functional head 110, the force applied to the press release activator 132 is transferred to the functional head 110. When the force applied through the push rod 230 is sufficient to overcome the frictional engagement forces between male ball and female socket connectors 233, 234, the male ball connector 233 will slide relative to the female socket or sleeve connector 234 and will thereby released. In a similar but converse fashion, a functional head 110 may be attached to the remainder of the bathroom apparatus 100 by sliding the female socket connector 234 over the male ball connector 233 such that these complimentary connectors are engaged and hold the functional head 110, such as a plunger head as depicted in FIGS. 1-5, securely to the elongated handle 120. As seen in FIG. 2, a release facilitating member 150 may also be used in conjunction with the bathroom apparatus 100 and may include a protrusion 155 sized and shaped to fit in orifice 132 and facilitate activation of the release mechanism in configurations in which the push rod 230 sits flush. As such, the release facilitating member 150 acts as a punch to activate the release mechanism 130. In other contemplated configurations of a release mechanism a portion of the push rod 230 may extend beyond a flush position within the top of the grip 125. In such a configuration, the push rod 230 would be further accessible for depression and activation, however, it could also be inadvertently depressed during use of the bathroom apparatus 100 such that a more flush configuration of the actuator 132 may be preferable to prevent inadvertent release of the functional head 110. As is understood by those skilled in the art, the connectors 233, 234 are formed to have both material rigidity and flexibility so as provide a securing function while still enabling sufficient flexibility such that when the release mechanism 130 is activated the functional head 110 is released from being coupled to the remainder of the bathroom apparatus 100.

Additionally, the release mechanism 130 may alternatively be a pressurized air or $CO_2$ release mechanism 130 as is known in the art. The pressurized air or $CO_2$ may be housed in a container as is known in the art and may be housed in the apparatus 100 in variety of locations including internal compartment 1010 where it may be operably coupled to the internal cavity 139 so as to provide pressurized force for releasing a functional head 110. (See FIG. 10) For example, a user may press a release actuator 132 such as a user input in the form of a depressible button which causes pressurized air to be released and pressed against the top 111 of the functional head 110 and overcome the connective frictional force coupling the functional head 110 to the elongated handle 120. In other configurations the released pressurized air will push on a member such as a push rod 230 that in turn pushes downward on the top 111 of the functional head to force it off so that it can be disposed of as described herein. Since the pressurized air or $CO_2$ is provided in a burst, a new functional head 110 may then later be attached to the remainder of the bathroom apparatus 100 so as to provide replacement head functionality.

One example of material contemplated is poly vinyl alcohol (PVOH). PVOH may be manufactured in a certain manner so as to provide requisite rigidity and structural integrity to withstand functional needs such as withstanding the forces applied to a toilet bowl plunger while also permitting sufficient flexibility for use in female socket connector 234. PVOH is among the materials strong enough to withstand hydraulic loads from plunging yet still be dissolvable in cold water typically found in toilets. Likewise, the desired resiliency characteristics and the desired dissolution may be accomplished with a functional head with a particular grade of PVOH. Using materials such as PVOH for the plunger head including the connector component 234 thereby permits the entire functional head 110 to be disposable in a toilet bowl as the entire functional head 110 can be dissolved and flushed and disposed of without removing the functional head 110 from the toilet bowl region. Accordingly, improved sanitation is improved as the contents of the toilet will not be spread throughout the bathroom or the remainder of the building when transporting a bathroom apparatus including the functional head 100.

PVOH is a readily biodegradable water soluble polymer. It has no harmful residues and can be ultimately biodegraded to common naturally occurring substances of carbon dioxide, water, and biomass. PVOH can be degraded using any of a number of varied processes that include mechanical, thermal, photochemical, ultraviolet, biological and chemical processes. For example, micro-organisms, moulds or yeasts may be used to degrade PVOH including a functional head such as a plunger head. In one instance, micro-organisms biodegrade the functional head as they use PVOH as a food source by producing a variety of enzymes that react with PVOH producing end by-products of only naturally occurring substances. PVOH can be formed and worked into certain desirable configurations. Also certain PVOH grades can be engineered to dissolve according to desired characteristics that may include a desired time frame, a desired temperature, and desired activators. As such, the functional head may be substantially diffused in a variety of ways and thereby can be flushed or disposed in other fashion. Increased decomposition and water solvency can accordingly be achieved. Also, through selection of particular PVOH grades the correct dissolution characteristics may be achieved including a clear water appearance without discoloration in order to provide a preferred aesthetic appearance in a toiler bowl. With increased focus on providing products with minimal to no effects on the environment, dissolvable plungers, cleaning products, and other devices utilizing the PVOH material that dissolves down to natural occurring or biodegradable and bio-friendly products are continually creasing in popularity and marketability.

In certain configurations, various agents including cleaning agents or sanitizing agents may be integrated into the material composition of the functional head such that further cleaning or sanitizing functions may be accomplished as the functional head dissolves such as in the water in a toilet. For example, a toilet cleaning agent may be integrated into the PVOH material formed into a dissolvable plunger head such that when the plunger head is disposed of in the toilet and dissolves the cleaning agent is released and the toilet bowl may also be cleaned coincident with or after the plunging process has occurred. The agents may also be used as a trigger to control or facilitate dissolution at a desired rate including an increased dissolution rate. As is known in the art, the rate of dissolution can be controlled by varied pH activators. In at least one configuration, a sachet is incorporated into the functional head during manufacturing and is later used to expedite dissolution of the functional head. The functional head may begin dissolving and the material of the sachet released and will act as a catalyst to speed up the rate at which the PVOH of the functional head dissolves.

It is desirable for dissolution of the functional head to be fairly rapid as users will want the functional head to be dissolved and be able to be flushed away so that the toilet may be returned to its normal operating appearance. However, if the functional head is configured to dissolve too rapidly the function for which it is designed such as plunging, cleaning, or scraping may not be fully completed by time the functional head has dissolved completely or in sufficient manner such that the head is not longer effective for its intended purpose. For example, a dissolvable plunger head may be manufactured from certain grades of PVOH such that is dissolves in under twenty (20) minutes of interaction with the activator which in many instances may be water at room temperature in a toilet bowl. Certain configurations are also formed such that the time frame of dissolution is between two (2) and fifteen (15) minutes or even more particularly three (3) to ten (10) minutes. Varied environmental conditions may cause some variations to the expected dissolution time period. For example, varied parameters such as pH, temperature, or amount or percentage of chorine residuals may affect the reaction to dissolve the functional head and thereby may vary the reaction time.

Varied grades of PVOH are examples of an illustrative material that is suitable material for a dissolvable functional head for varied household products such as dissolvable plungers and dissolvable cleaning devices. A rigid PVOH may be manufactured to particular specifications as the functional heads may be manufactured using blow molding or extrusion of the PVOH. Again other materials with similar properties of dissolvability, sufficient rigidity to withstand forces involved in plunging or cleaning process, and ease of manufacturing as PVOH as are known in the art may also be utilized.

Another illustrative example of materials that the dissolvable functional heads 110 including plunger heads may be formed from may be plastic substitutes. One example of such a plastic substitute may be by-products from animals including livestock or farm animals. For example various compositions may be formed from proteins such as protein and clay combinations. It is well understood that approximately 80% of the proteins in a cow's milk may be formed of casein, a substance known to be used in adhesives and paper coatings. In a similar manner casein may be used in combination with other substances to boost cohesiveness. Casein may be combined with glyceraldehyde of the clay to enhance the cohesive attributes of the protein molecules in casein further linking these protein molecules together. Resulting compositions may be treated including temperature treatments such as chilling, freezing or heating or other treatments to enhance the characteristics of the material. The resulting material may have sufficient strength characteristics to withstand the forces applied to a plunger head or other functional head during use and will dissolve and/or biodegrade in a short period of time upon disposal.

Alternatively plants and their extracts or processed components may also be used as a potential material for a biodegradable dissolvable functional head. Plants and their extracts are biodegradable and can often be ground, mixed and treated and processed so that they may be used as a biodegradable material for a variety of products exhibiting varied characteristics. Accordingly, functional heads may be formed in a like fashion.

In certain configurations, the bathroom apparatus 100 may also be configured to have a removable sleeve 235, which among other things, may help prevent the remainder of the bathroom apparatus from being contaminated with contents from a toilet bowl during use of a functional head 110 such as plunger head. Similar to the dissolvable functional head 110 described herein, the sleeve 235 may be formed of like material (e.g. PVOH or other materials described above) to facilitate use and discarding, dissolving and flushing of the sleeve 235 so as to prevent removal of any contaminate from a toilet bowl.

Figure 4:
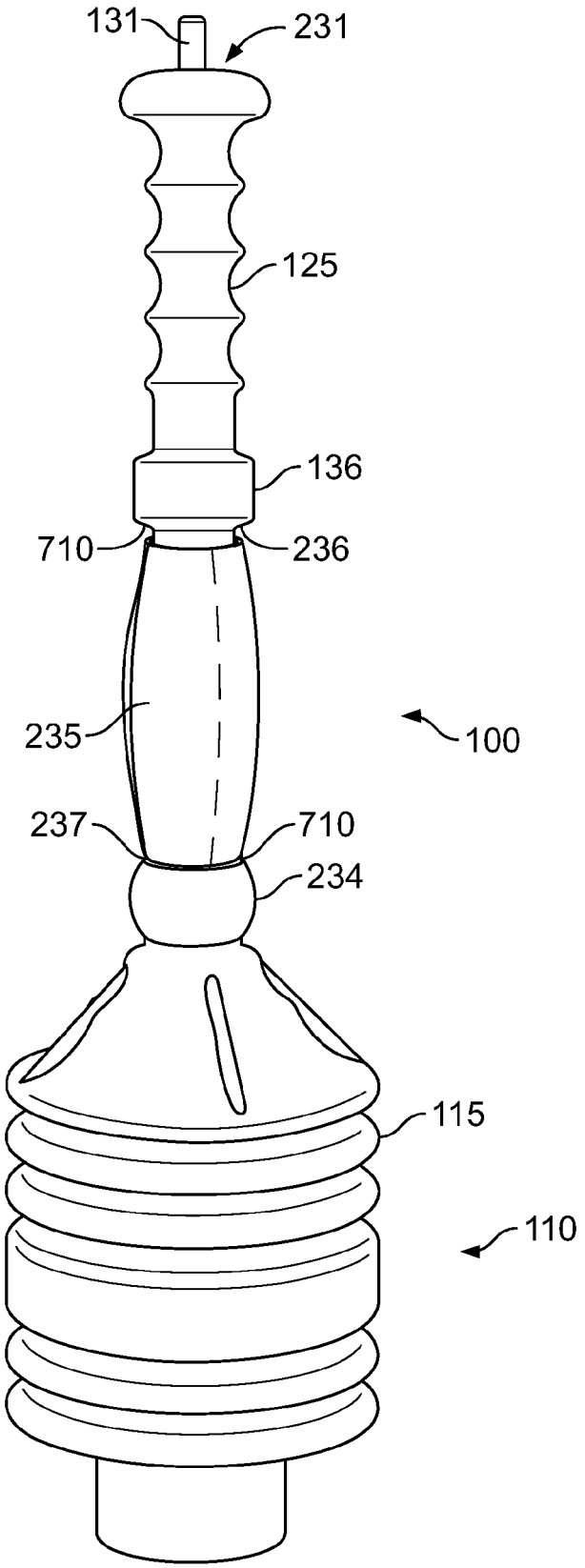
FIGS. 4 and 5 are illustrative perspective views of the bathroom apparatus of FIG. 1 with a removable sleeve.
Figure 5:
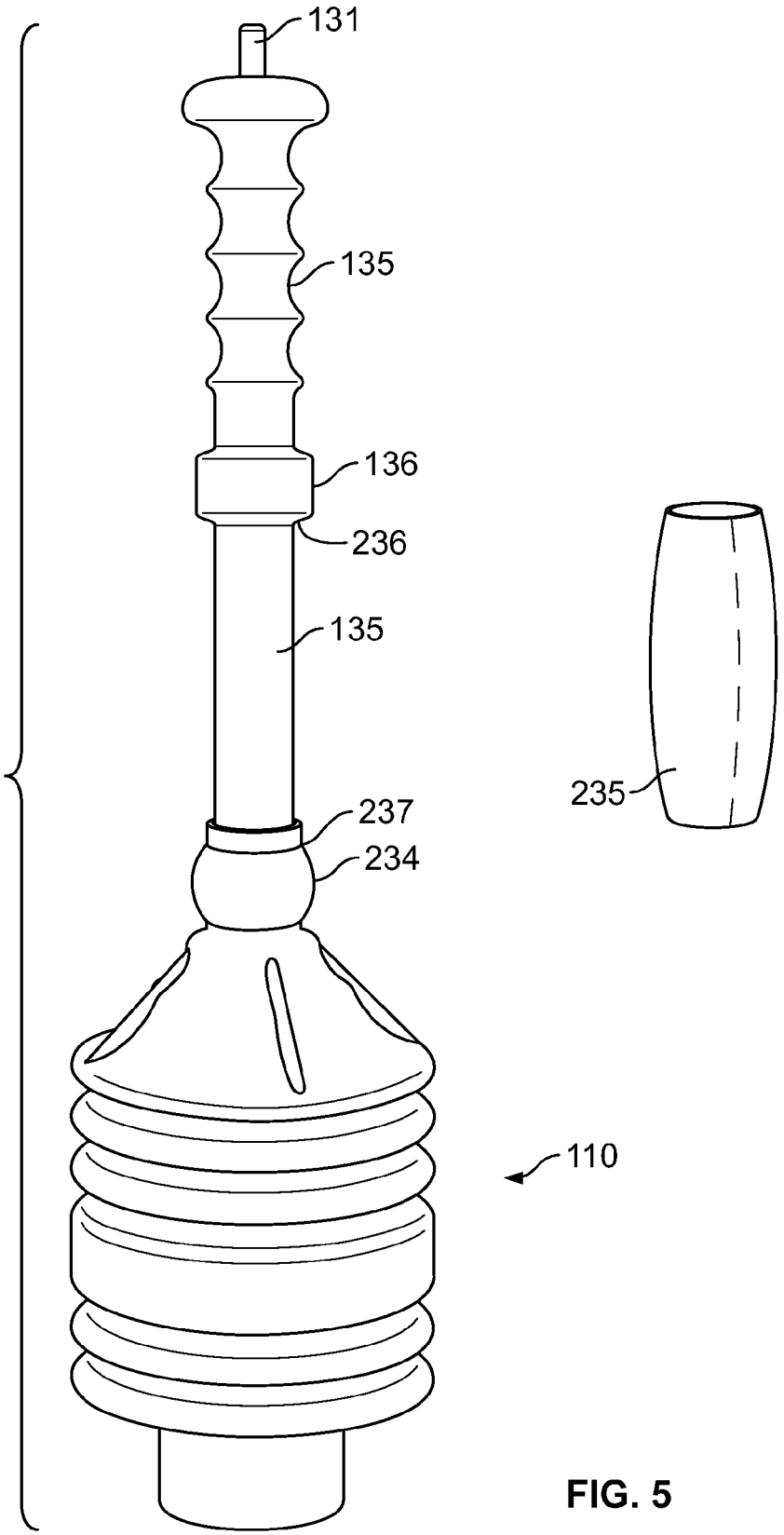

FIGS. 4 and 5 are illustrative perspective views of the bathroom apparatus of FIG. 1 with a removable sleeve 235. The sleeve 235 may be sized and shaped to be housed in the elongated handle 120 and fit over at least a portion of the middle region 135, the region between the grip 135 and male ball connector 233. In order to prevent the elongated handle 120 from being contaminated by fluids and material from a toilet bowl when the bathroom apparatus 100 is used, for example to plunger a toilet bowl, the sleeve 235 may be complimentary shaped to wrap around the outer surface of the elongated handle 120 and thereby provide a protective barrier for the elongated handle 120 preventing the toilet fluids from contacting the handle itself. In some configurations the sleeve 235 may have a particular length to complimentary fit between grip stop 136 at the bottom end of the grip and the female socket connector 234. In such a configuration, the sleeve 235 may completely cover the elongated handle 120 between the grip 135 and the female socket connector 234. As such, if desired, the sleeve 235 can be sized to form a seal to prevent contamination of the elongated handle 120 in that region as well. It also contemplated that the sleeve 235 may be formed by multiple components attached together and not just by a single body or unibody component if desired. The sleeve 235 may also have a fairly close or snug fit in certain configurations. On a snug fit configuration the sleeve 235 may need to be peeled from the elongated handle 120 rather than merely being slid off or allowed to fall off as a result of gravity.

Because the sleeve 235 is dissolvable, it can be discarded and another sleeve 235 may be placed on the bathroom apparatus 100 when a new functional head 110 is placed on the bathroom apparatus 100. In particular, a user may plunger a toilet using the bathroom apparatus 100 with the configuration shown in FIG. 4. Then when the user is finished plunging the toilet, the user may depress the actuator 132 which causes the plunger head 110 to be released into the toilet (see FIG. 7). The female socket connector 234 and its raised edge 237 may serve as a point of abutment 710 with the sleeve 235 preventing the sleeve 235 from sliding down the elongated handle 120 when held such that gravity was pulling on it. Likewise a raised edge 236 may be located on the grip stop 136 and may also serve as a similar point of abutment 710. However, with the plunger head 110 discarded, the sleeve 135 may slide on its own or can easily be forced with the assistance of the user's hand to slide off the elongated handle 120. As such, the plunger head 100 and the protective sleeve 235 may be discarded in unison into the toilet bowl such that the remainder of the bathroom or other surrounding rooms are contaminated with drippings or spray from the interior of the toilet, as shown in FIG. 7.

Figure 6:
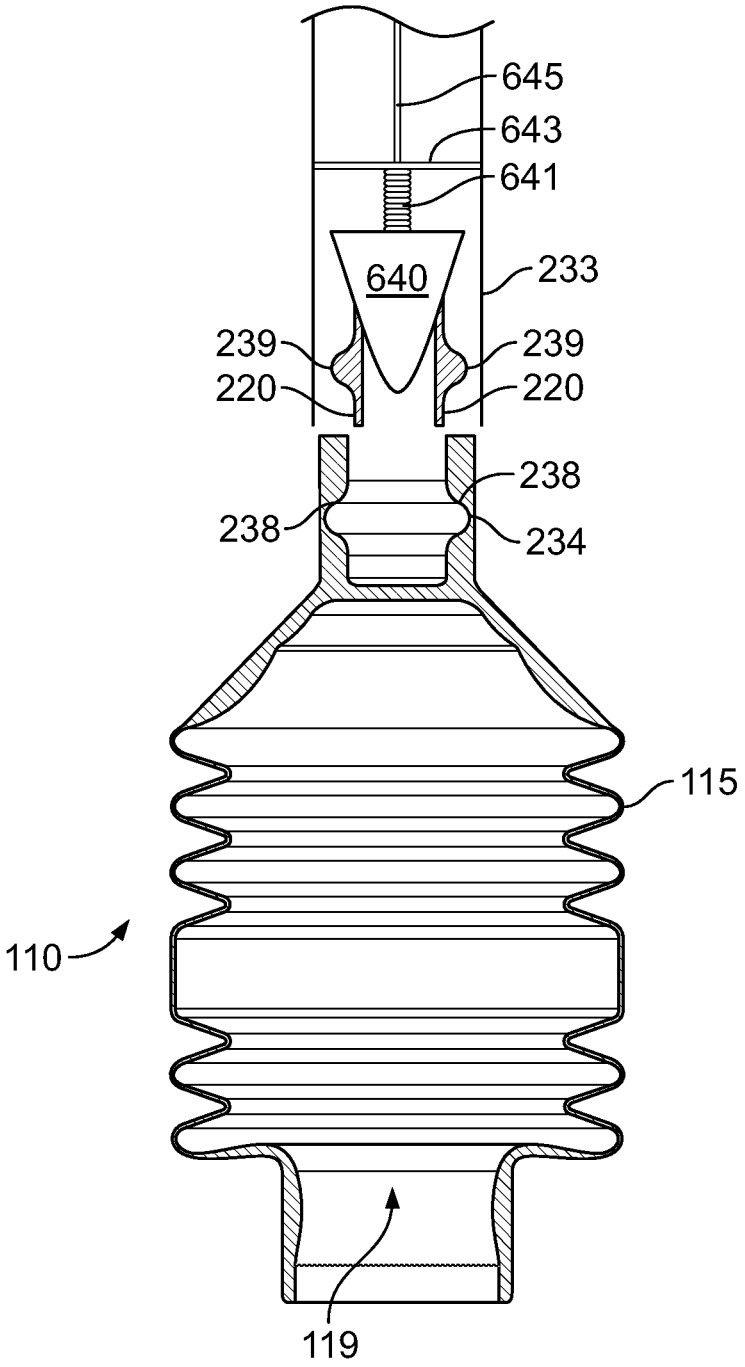
FIGS. 6 and 7 are illustrative perspective views of another configuration of a bathroom apparatus in an engaged and released orientation respectively.
Figure 7:
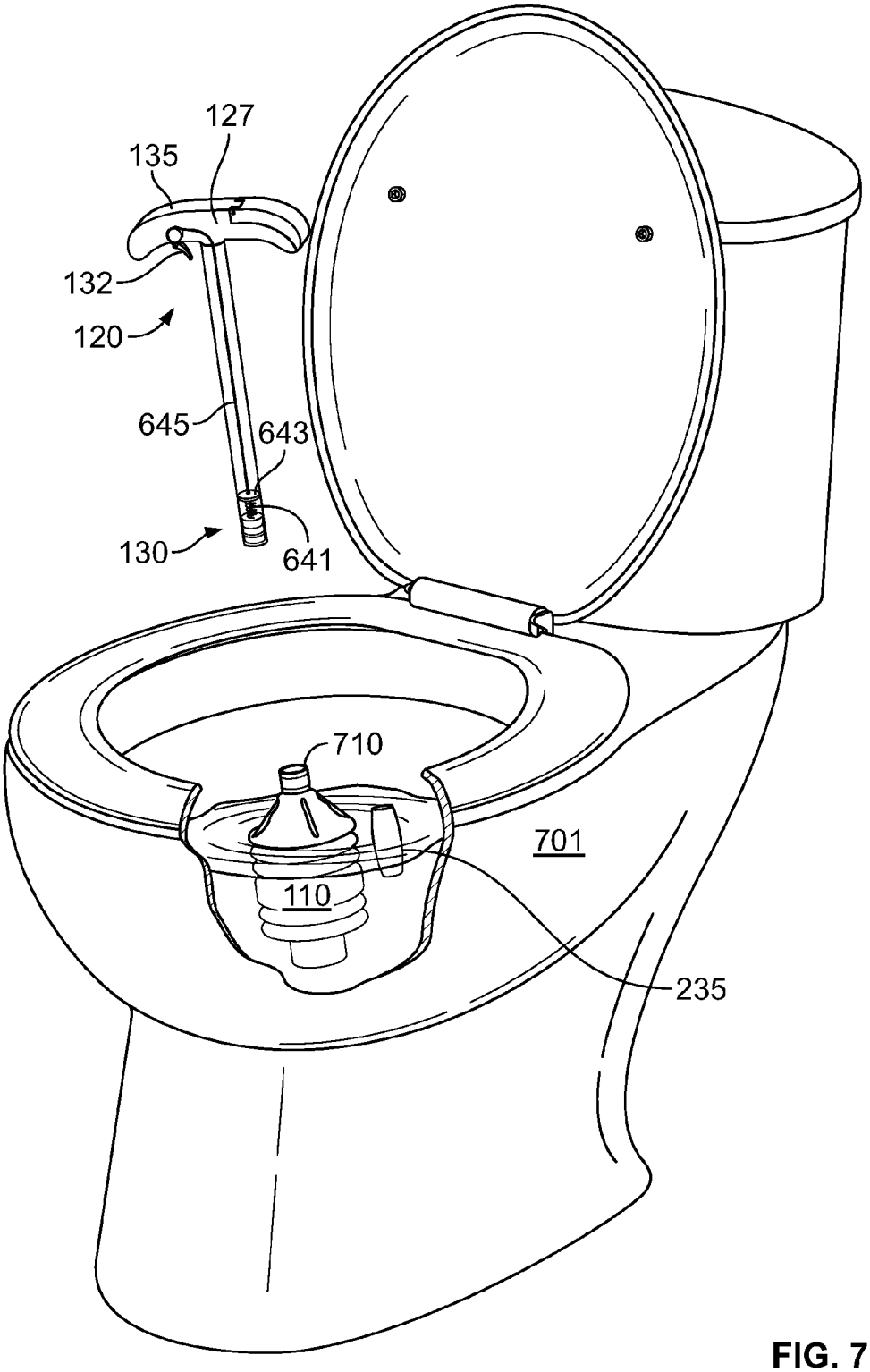

FIGS. 6 and 7 are illustrative perspective views of another configuration of a bathroom apparatus 100 in an engaged and released orientation respectively. The bathroom apparatus 100 shown here has a varied shape to the elongated handle 120 as well as a varied release mechanism 130. However, the general operation is substantially similar to that of the bathroom apparatus configuration of FIGS. 1-5. Like the previous described configuration, the bathroom apparatus illustratively depicted in FIGS. 6-7 utilizes male and female socket connectors 233 and 234 to engage and disengage one another when in use and when the functional heads are to be removed and disposed of or when a new functional head is to be put in place for use on the bathroom apparatus 100. Additionally, in each of the previous configurations illustratively shown above as well as the configurations described otherwise herein, the male and female connector positions may be reversed. For example, the male connector may be housed on either elongated handle 120 or on the functional head 130 and the opposing female connector can be housed on either as well, as long as one male connector is on either the elongated handle 120 or the functional head 130 and a complimentary female connector is on the other component. This concept and interplay between "male" and "female" connectors is well known in the art.

FIGS. 6 and 7 illustratively depicts a bathroom apparatus 100 with a T-shaped profile in an engaged and released position respectively, with a plunger head 110. A handle grip 135 may again be housed on the elongated handle 120. In particular, in the shown T-shaped configuration, the grip 135 may preferably be placed on the cross member 127. The cross member 127 may allow for improved leverage especially if the functional head is a plunger head 110 and plunging is needed. Likewise, use of the T-shaped bathroom apparatus may be preferable in difficult cleaning jobs to allow more force to be applied downward on a cleaning type functional head 110. It may also allow further motion and rotational aspects, including twisting. Further, the release mechanism 130 has a varied configuration including the male and female connectors 233, 234. Here male connector 233 is housed on the elongated handle 120 and includes a pair of cantilevered members 220 with domed protrusions 239. In complimentary fashion, the functional head 110 has housed internally in a bottom cavity of a complimentary socket connector 234 which includes two depressions 238 positioned complimentary to the protrusions 239. Also, a biasing member 640 is also housed in the bottom cavity to facilitate connection of the functional head 110 to the elongated handle 120. The biasing member 640 may have a rounded, inclined or other shape or virtually any shape as long as it is shaped to force the cantilevered members 220 part when a user pushes a functional head 110 upward to secure the functional head 110 to the elongated handle 120. As such, the biasing member 640 must be configured to thereby fostering a secure connect by forcing the cantilevered members 220 apart into the complimentary depressions 238 to provide a snug fit.

In order to release the functional head 110, the biasing member 640 is withdrawn such that the connection is released. Here, as show in FIGS. 6 and 7, the biasing member 640 is abutted in a top end by a compression spring 641 wound around a cable 645 running from the biasing member 640 upward through the elongated handle up to a release actuator 132 housed on an under side of the cross member 127. To release the functional head 110, a user pulls the release actuator 132 which pulls the cable 645 upward and thereby pulls on the biasing member 640 compressing the compression spring 641 against backstop 643 and releasing the connectors 233 and 234. When the user releases the release actuator 132 the physical properties of the compression spring 641 cause it to extend, pushing the biasing member 640 downward such that is positioned in its pre-engagement position and ready to receive another functional head 110 for future use of the bathroom apparatus 100.

Figure 8:
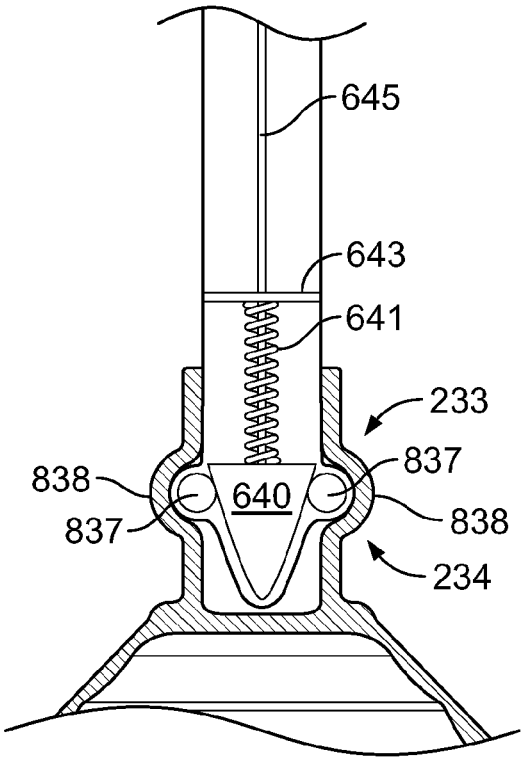
FIGS. 8 and 9 are illustrative enlarged views of an alternate configuration of a securing mechanism for a bathroom apparatus in an engaged and released configuration respectively
Figure 9:
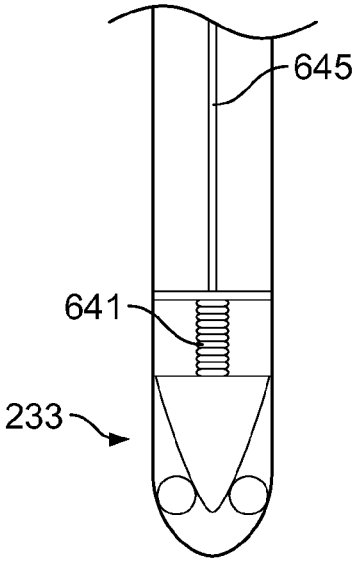

FIGS. 8 and 9 are illustrative enlarged views of an alternate configuration of a securing and release mechanism 130 for a bathroom apparatus 100 in an engaged and released configuration respectively. The securing mechanism 130 in the bathroom apparatus 100 configuration illustratively shown in FIGS. 8 and 9 is similar to that described with respect to FIGS. 6 and 7 with some modifications. For example, here the male connector 233 is again housed on the elongated handle 120 and the female connector is housed on the functional head 110. However, as described the location of the male and female connectors 233 and 234 are generally interchangeable depending on particular preference. Again a biasing member 640 is coupled to a cable that runs the release actuator 132 and is held in place by a compression spring 641 housed against backstop 643. However, here ball bearings 837 internally housed within the end of the elongated handle 120 are pushed outward by the biasing member 640 to provide engaging force to allow for engagement and release with respect to depressions 838.

Figure 10:
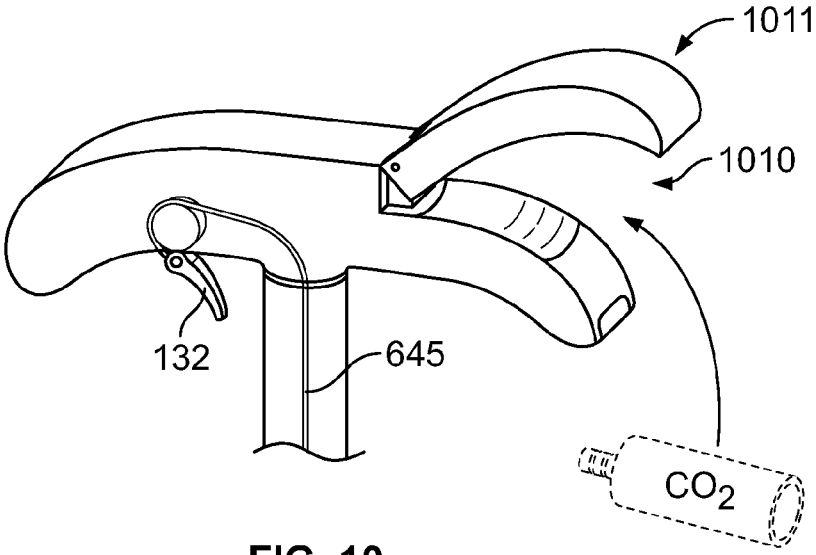
FIG. 10 is an illustrative enlarged view of a hinged lid and internal compartment on the handle of a bathroom apparatus similar to the configuration shown in FIGS. 6 and 7.

It is contemplated that the bathroom apparatus may also contain various optional features. It may be desirable to have further useful attributes to enhance the smell or sanitation in the bathroom when using the bathroom apparatus 100 regardless of whether using it a plunger configuration, cleaning device configuration or other contemplated configurations. FIG. 10 is an illustrative enlarged view of a hinged lid and internal compartment on the handle of the bathroom apparatus of FIGS. 6 and 7. As shown the internal compartment 1010 may house air fresheners, drying cloths, sponges, cleaning fluids, antibacterial or disinfecting sprays and other bathroom products. As shown, depending on desired use the internal compartment may be sized and configured accordingly. When the bathroom apparatus is in use, the lid 1011 may be closed, and in some configurations secured with a securing component such as a latch or lock to prevent unintentional opening. Should a user desire use of the contents of the internal compartment, the user may open the lid and remove the contents. The bathroom apparatus is able to thereby keep desired air fresheners, drying cloths, sponges, cleaning fluids, antibacterial or disinfecting sprays and other bathroom products in an accessible location should a user desire to use it in conjunction with the bathroom apparatus.

Figure 11A:
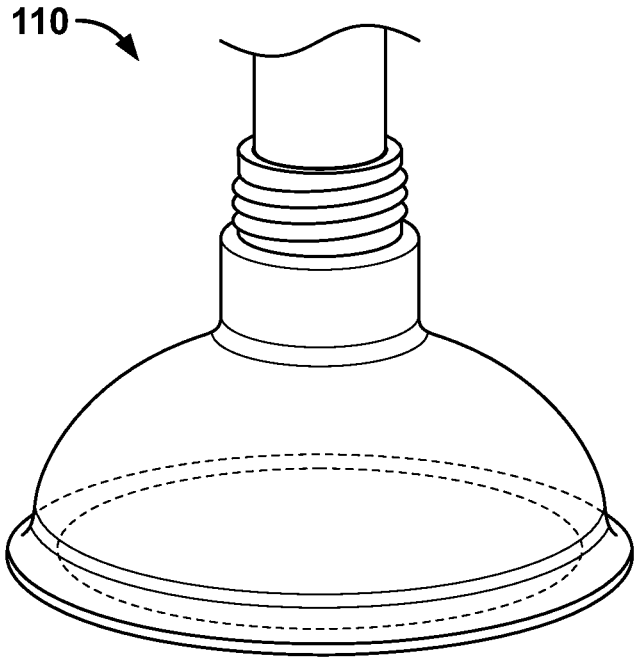
FIGS. 11A-11E are schematic views of illustrative functional head configurations.
Figure 11B:
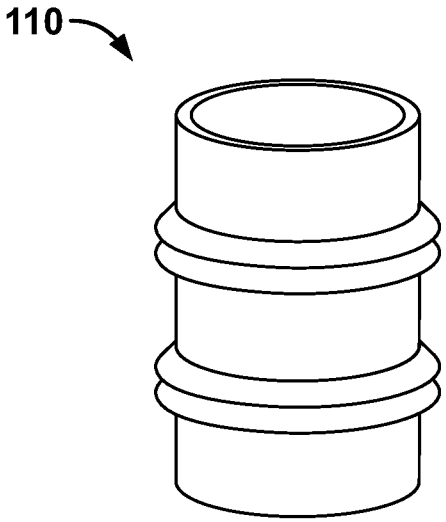

The bathroom apparatus has been illustratively shown with an illustrative example of a functional head 110. For example, the apparatus of FIGS. 1-10 may be characterized as having a plunger head 110. The plunger head 110 of FIG. 1 is hollow with a cavity 119 and has a top 111 and bottom 112, with the bottom being an orifice 113 to facilitate creation of suction as is well known in the art. Additionally, the plunger head 110 may be described as bellowed or as having an accordion profile or shape. The bellows 115, like that of an accordion, facilitate movement of air and pressurization so as to facilitate the suction effect of a plunger and enhance the functionality and ease of use of a plunger configured to have bellows. FIGS. 11A-B illustratively depict other variations of functional heads 110, plunger heads in particular. FIG. 11A illustratively shows a conventional plunger head while FIG. 11B illustratively depicts another configuration of a bellowed plunger head.

Figure 11C:
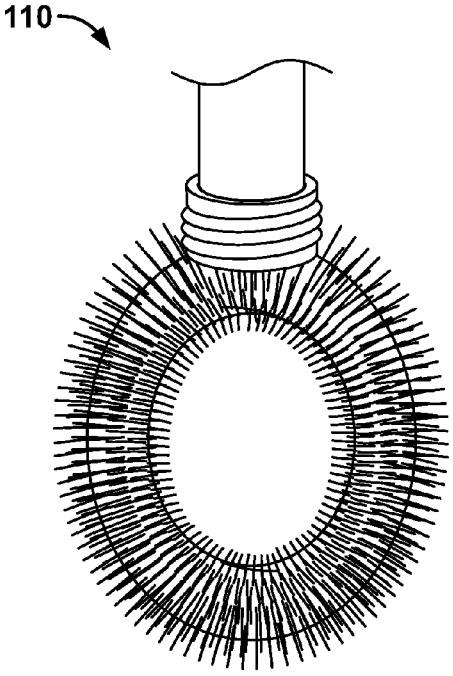
Figure 11D:
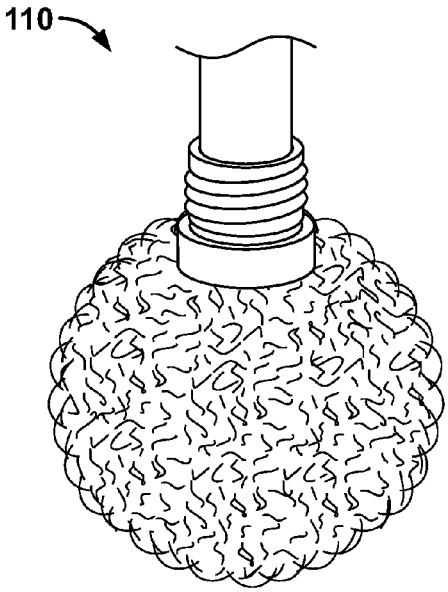
Figure 11E:
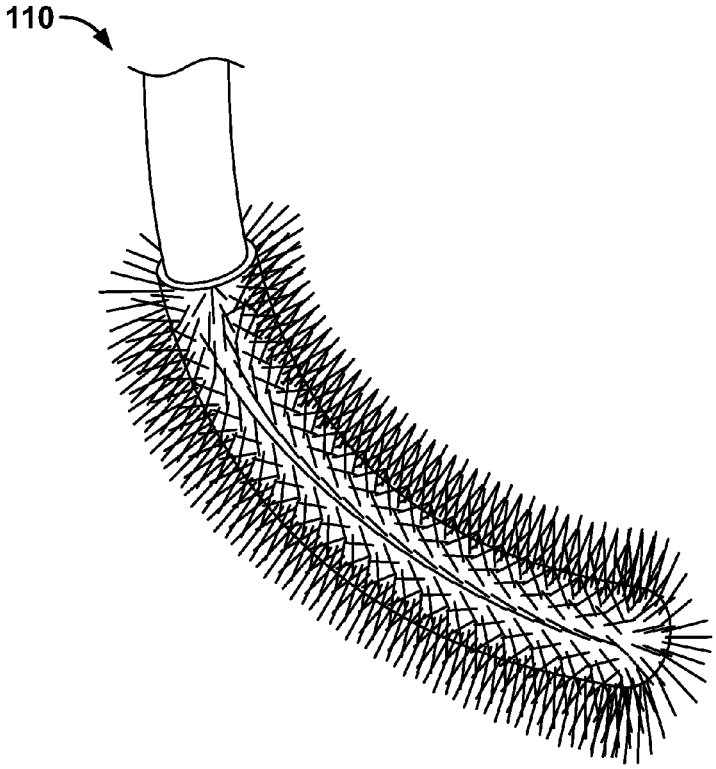

Various other functional heads 110 including cleaning heads, brushes, pipe cleaners and scrapers may be utilized as part of the bathroom apparatus as shown and described. FIGS. 11C-E illustratively depict more configurations of exemplary functional head configurations including two toilet brushes and a pipe cleaning head, respectively. Various other configurations are contemplated and may include a variety of functional heads 110 as are known to those skilled in the art.

Figure 12:
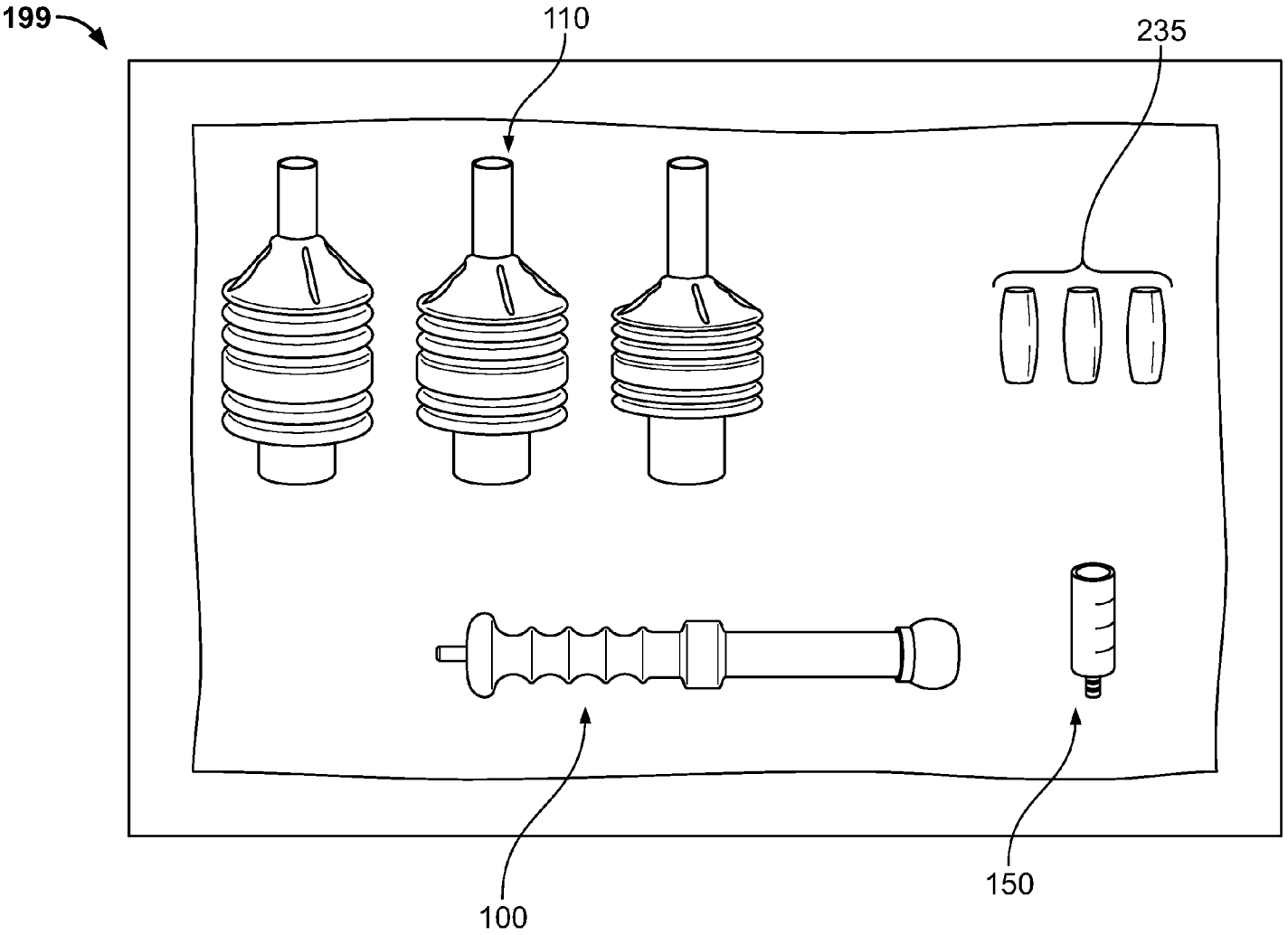
FIG. 12 depicts an illustrative kit including a bathroom apparatus, replacement functional heads, replacement protective sleeves, and a release facilitating member.

It is also contemplated that the various configurations of the bathroom apparatus 100 and/or its components may be packaged and sold in a kit 199. For example, as illustratively depicted in FIG. 12, the bathroom apparatus 100, replacement functional heads 110, and replacement protective sleeves 235 as described herein may be sold in kit 199. Additionally, a release facilitating member 150 may also be included as part of kit 199 as desired. Likewise replacement functional heads 110 and replacement protective sleeves 235 may be packaged and sold individually or together. For example, a package of dissolvable plunger or toilet brush heads 110 may be sold individually or with dissolvable sleeves 235. Accordingly, a product and replacement functional heads is contemplated for sale as a kit.

Figure 13:
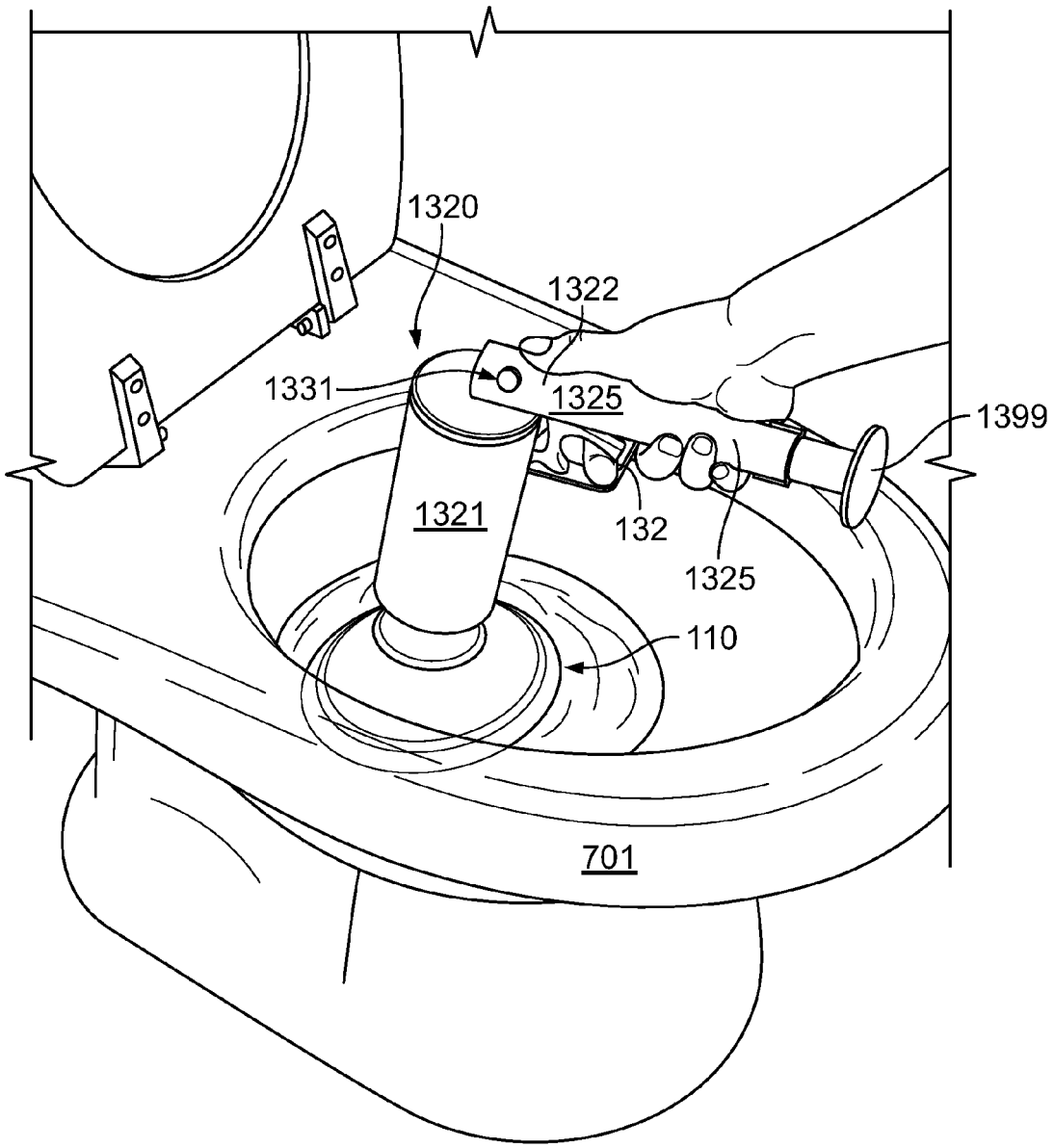
FIG. 13 is an illustrative view of an air powered bathroom apparatus in use in a toilet.

FIG. 13 illustratively depicts another illustrative configuration of a bathroom apparatus, an air powered plunger 100. The plunger 100 has a plunger head 110 at one end and an elongated handle 1320 formed in two sections in an angled elbow. The lower section 1321 is cylindrical in shape or in some configurations may be bellowed with an accordion-like appearance while the upper portion is an elongated tube 1325 with a release actuator or trigger 132 housed on the outer surface and a piston 1399 housed within the cylinder and extending out the rear of the cylinder. While conventional plungers rely on physical movement of the plunger handle up and down to compress and expand the plunger head, air powered plungers or drain cleaners such as the one illustratively shown in FIG. 13 rely upon pressurized gas including air or $CO_2$ to provide a force to suction or plunger the drain to remove a clog in a toilet, shower, or sink. In order to supply an air burst the air powered plunger 100 is locked or suctioned into place and the piston is pulled rearward to create a further suction akin to a conventional plunger however without having to move the plunger or drain cleaner 100 and instead merely by creating air pressure by pulling the piston 1399 through the cylinder. As was described previously, the functional plunger head in the configuration shown in FIG. 13 can be released in the toilet 701 by depressing the release mechanism and release button 1331. The biodegradable dissolvable plunger 110 thereby will be left in the toilet to dissolve and be flushed away and the remainder of the air powered plunger will be removed in a more sanitary fashion for use again at a later time with a new dissolvable biodegradable head 110. While one configuration of air powered or pressurized air plunger or drain cleaner has been shown and described with regard to FIG. 13, it is well understood that various particular configurations of air powered or pressurized air plungers or drain cleaners are contemplated consistent with that described here including those having varied arrangements of components and varied manners of forming the pressurized air.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

I claim:

1. A bathroom apparatus comprising:

a single use dissolvable functional head comprising one of a plunger head and a cleaning head, the functional head having a flexible female socket connector having an inner concaved surface with respect to a centerline of the functional head;

an elongated handle having a male ball socket connector releasably coupled at a first end to the female socket connector of the single use dissolvable functional head, wherein the male ball socket connector includes a convex outer surface having a complementary shape of the inner concaved surface of the female socket connector; a second end of the elongated handle being disposed opposite of the first end of the elongated handle, the second end having an orifice; a single use dissolvable sleeve covering a portion of the elongated handle;

a release mechanism for releasing the single use dissolvable functional head from the first end of the elongated handle, wherein the release mechanism includes a rod axially disposed within the elongated handle, one end of the rod having an ejector plate coupled thereto and the opposing end of the rod being disposed below the orifice of the elongated handle; a punch device having a body with a protrusion adapted extend into the orifice to abuttedly engage said opposing end of the rod; the rod including a shoulder portion disposed between the ejector plate and the opposing end of the rod, the shoulder portion for aligning the rod within the elongated handl; the rod being axially movable relative to the elongated handle, the ejector plate configured to abut the dissolvable functional head and provide an axial force to the dissolvable functional head responsive to axial movement of the ejector plate towards the dissolvable functional head; wherein the single use dissolvable sleeve is configured to slide off the male ball socket connector of the elongated handle when the single use dissolvable functional head has been released from the elongated handle.

2. The bathroom apparatus of claim 1, wherein the single use dissolvable functional head is a plunger head.

3. The bathroom apparatus of claim 1, further comprising:

a plurality of replacement single use dissolvable functional heads and a plurality of replacement single use dissolvable sleeves.

4. The bathroom apparatus of claim 2, further comprising:

a plurality of replacement single use dissolvable plunger heads and a plurality of replacement single use dissolvable sleeves.

5. The bathroom apparatus of claim 4, wherein the single use dissolvable plunger heads and the single use dissolvable sleeves are composed of polyvinyl alcohol.

6. The bathroom apparatus of claim 5, wherein the single use dissolvable heads and the single use dissolvable sleeves are water soluble and are configured to dissolve within twenty minutes of being placed in water.

7. The bathroom apparatus of claim 6, wherein the single use dissolvable heads and the single use dissolvable sleeves are configured to dissolve in two to fifteen minutes of being placed in water.

8. The bathroom apparatus of claim 7, wherein the single use dissolvable heads and the single use dissolvable sleeves are configured to dissolve in three to ten minutes of being placed in water.

9. A plunger comprising:

a dissolvable plunger head having a flexible female socket connector having an inner concaved surface with respect to a centerline of the functional head;

an elongated handle having a male ball socket connector releasbly coupled at a first end to the female socket connector of to the dissolvable plunger head, wherein the male ball socket connector includes a convex outer surface having a complementary shape of the inner concaved surface of the female socket connector; a second end of the elongated handle being disposed opposite of the first end of the elongated handle, the second end having an orifice; and a release mechanism configured for releasing the dissolvable plunger head from the first end of the elongated handle; wherein the release mechanism includes a rod axially disposed within the elongated handle, one end of the rod having an ejector plate coupled thereto; and the opposing end of the rod being disposed below the orifice of the elongated handle; a punch device having a body with a protrusion adapted extend into the orifice to abuttedly engage said opposing end of the rod; the rod including a shoulder portion disposed between the ejector plate and the opposing end of the rod, the shoulder portion for aligning the rod within the elongated handle; the rod being axially movable relative to the elongated handle, the ejector plate configured to abut the dissolvable plunger head and provide an axial force to the dissolvable plunger head responsive to axial movement of the ejector plate towards the dissolvable plunger head to release the female socket connector from the male ball socket connector.

10. The plunger of claim 9, further comprising a dissolvable sleeve configured to be housed on a portion of the elongated handle and to slide off the elongated handle when the single use dissolvable functional head has been released.

11. The plunger of claim 10, wherein the dissolvable sleeve is configured to cover a portion of the handle adjacent to the dissolvable plunger head.

12. The plunger of claim 11, wherein the dissolvable plunger head and the dissolvable sleeve are formed as a single piece component.

13. The plunger of claim 11, wherein the dissolvable plunger head and the dissolvable sleeve are both composed of poly vinyl alcohol.

14. The plunger of claim 9, wherein the dissolvable plunger head is soluble in water.

15. The plunger of claim 14, wherein the dissolvable plunger head is configured to dissolve within twenty minutes of being placed in water.

16. The plunger of claim 14, wherein the dissolvable plunger head is configured to dissolve within two to fifteen minutes of being placed in water.

17. The plunger of claim 14, wherein the dissolvable plunger head is configured to dissolve within three to ten minutes of being placed in water.

18. The plunger of claim 14, wherein the dissolvable plunger head is composed of a biodegradable water soluble polymer.

19. The plunger of claim 10, wherein the dissolvable plunger head and the dissolvable sleeve are composed of a biodegradable water soluble polymer.

20. The plunger of claim 9, wherein sides of the dissolvable plunger head are bellowed with an accordion profile.

21. A method of disposing of a plunger head in a toilet comprising the steps of:

providing air pressure to a drain to release a drain clog with an apparatus including a plunger head;

causing a release mechanism to release a plunger head having a flexible female socket connector including an inner concaved surface with respect to a centerline of the functional head coupled to a male ball socket connector having a convex outer surface having a complementary shape of the inner concaved surface of the female socket connector, the male ball socket connector disposed at one end of an elongated handle; wherein the release mechanism includes a rod axially disposed within the elongated handle, one end of the rod having an ejector plate coupled thereto and the opposing end of the rod being disposed below an orifice of the elongated handle; the release mechanism including a punch device having a body with a protrusion adapted extend into the orifice to abuttedly engage said opposing end of the rod; the rod including a shoulder portion disposed between the ejector plate and the opposing end of the rod, the shoulder portion for aligning the rod within the elongated handle; the rod being axially movable relative to the elongated handle, the ejector plate configured to abut the dissolvable plunger head and provide an axial force to the dissolvable plunger head responsive to axial movement of the ejector plate towards the plunger head; and causing the plunger head to contact water in a toilet for a period of time sufficient in length to cause at least a portion of the plunger head to dissolve.

22. The method of disposing of a plunger head in a toilet of claim 21, further comprising the step causing the plunger head to contact water in a toilet for a period of time sufficient in length to cause the entire plunger head to dissolve.

23. The method of disposing of a plunger head in a toilet of claim 21, further comprising the step of flushing the toilet to evacuate the plunger head from the bowl of the toilet.

24. The method of disposing of a plunger head of claim 21, wherein the step of causing a release mechanism to release a plunger includes activating a user input.

25. The method of disposing of a plunger head of claim 24, wherein the activating a user input includes one of pressing a depressible button and pulling a trigger.

26. The method of disposing of a plunger head of claim 21, further comprising the steps of:

dissolving the plunger head in a sufficient manner such that the plunger head is configured to be flushable down a toilet, the plunger head being composed of a biodegradable water soluble polymer.

* * * * *